United States Patent [19]

Doubleday et al.

[11] 4,405,112

[45] Sep. 20, 1983

[54] GANG FORM BOLT

[75] Inventors: Max Doubleday, Caldwell; Anthony J. Gallis, Lake Hiawatha, both of N.J.

[73] Assignee: Harsco Corporation, Camp Hill, Pa.

[21] Appl. No.: 367,108

[22] Filed: Apr. 9, 1982

[51] Int. Cl.[3] ..... E04G 17/00

[52] U.S. Cl. ..... 249/207; 249/213; 249/219 R; 249/44; 249/45

[58] Field of Search ..... 249/44, 45, 207, 219 R, 249/219 W, 191, 213

[56] References Cited

U.S. PATENT DOCUMENTS

| | | | |
|---|---|---|---|
| 3,067,479 | 11/1962 | Schimmel | 249/41 |
| 3,142,883 | 8/1964 | Kort et al. | 249/45 |
| 3,584,827 | 6/1971 | Shoemaker | 249/45 |
| 3,655,162 | 4/1972 | Shoemaker | 249/219 W |
| 3,756,555 | 9/1973 | Doubleday et al. | 249/207 |
| 3,945,602 | 3/1976 | Doubleday et al. | 249/219 R |
| 4,221,357 | 9/1980 | Bowden et al. | 249/191 |

*Primary Examiner*—Donald E. Czaja
*Assistant Examiner*—Joel S. Baden
*Attorney, Agent, or Firm*—Kerkam, Stowell, Kondracki & Clarke

[57] ABSTRACT

A gang form or tie rod holding bolt is adapted for holding a tie rod passing through abutting frames of prefabricated panel units, the frames having mating slots. The tie rod holding bolt includes a body portion and a slot leg for extending through the mating slots, a middle leg for loading the frames, and a tie rod engaging leg for transferring a load from the tie rod to the holding bolt. The form slot leg and the middle leg are horizontally offset to straddle the tie rod and the middle leg is adapted to transfer the load to the frames, thereby providing the bolt with great stability under heavy loads. The design avoids eccentric load on the bolt. An assembly includes the bolt, tie rod, wedge pin and two frames.

15 Claims, 4 Drawing Figures

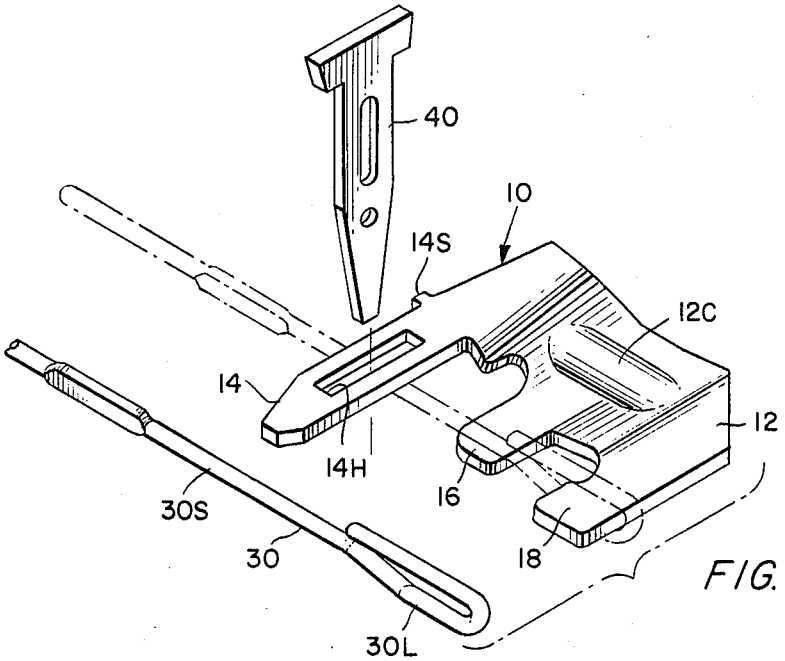
FIG. 1.
FIG. 2.
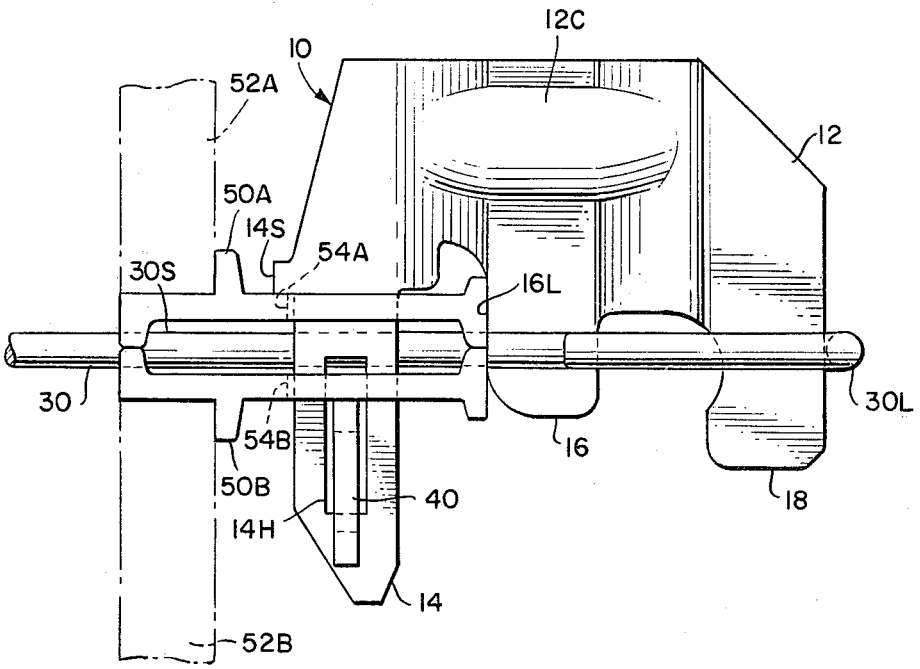

GANG FORM BOLT

BACKGROUND OF THE INVENTION

The invention relates to gang form bolts for use in holding a tie rod passing through abutting frames of prefabricated panel units.

This invention is an improvement on and an adaptation of the gang form bolt of U.S. Pat. No. 3,756,555, issued to Doubleday et al on Sept. 4, 1973, as assigned to the assignee of the present invention, and hereby incorporated by reference.

The use of prefabricated panels in a gang of formed sections either preassembled or assembled on the job is well known in the concrete pouring art. Such prefabricated units usually have a flat base of plywood or other suitable material of appropriate dimensions reinforced by a metal frame extending around the periphery of each unit. The metal frame is usually of I-shaped cross sections and edges thereof which abutt when the panel units are in position. These edges are suitably cut away to provide space for insertion of tie rods to extend between spaced gang from section between which the concrete is to be poured. The tie rods prevent the weight of the concrete from forcing the gang form sections away from each other.

The prior art includes numerous tie rod holding bolts as shown in the following U.S. Patents:

| U.S. Pat. No. | Issue Date |
|---|---|
| 3,067,479 - Schimmel | December 11, 1962 |
| 3,142,883 - Kort et al | August 4, 1964 |
| 3,584,827 - Shoemaker | June 15, 1971 |
| 3,655,162 - Shoemaker | April 11, 1972 |
| 3,945,602 - Doubleday et al | March 23, 1976 |
| 4,221,357 - Bowden et al | September 9, 1980 |

The Schimmel patent discloses a tie rod bolt including a form slot leg and a tie engaging leg. A notch disposed in between the form slot leg and the tie engaging leg is disposed adjacent the back of the frames.

The Kort et al patent discloses a tie rod and anchor bolt combination having a form slot leg and a tie rod engaging leg with two legs in between. The tie rod is curved to straddle the two legs between the slot leg and the rod engaging leg.

The two Shoemaker patents disclose Waler clamp assemblies for concrete wall forms, each assembly including a surface for abutting the back edges of the frames.

The Doubleday et al U.S. Pat. No. 3,756,555, incorporated by reference above, discloses a gang form bolt including a form slot leg, a tie engaging leg and a middle leg. The middle leg has a hold for accomodating a pin to hold the tie rod bolt in place. The form slot leg and the middle leg are in common horizontal plane. The tie rod holding bolt is arranged such that the load on the tie rod is transmitted to the frames by the form slot leg.

The Doubleday et al U.S. Pat. No. 3,945,602 discloses a U-shaped (in cross section) tie rod holding bolt including 2 back edges abutting the frames for load transmission.

The Bowden et al Patent discloses a tie rod assembly wherein the tie rod places a straight axial load on the tie rod holding bolt.

Although the above and other tie rod holding bolts have been generally useful, they are often subject to one or more of number of disadvantages. In particular, an increase in tension in the tie rod often has the tendency to tip the tie rod holding bolt or to bend the tie. Some prior art tie rod holding bolts have been under such tension that, when they are unloaded, the bolt has a tendency to snap off and act as a projectile which may be hazardous to personnel. Prior art designs which may at least partially overcome these problems are generally complex in construction, requiring more pieces than the basic tie rod, tie rod holding bolt and holding pin combination.

OBJECTS

Accordingly, it is a general object of the present invention to provide a new and improved gang form or tie rod holding bolt.

A further object of the present invention is to provide a gang form bolt which is extremely stable and quite resistant to tipping under heavy loads.

A further object of the present invention is to provide a gang form or tie rod holding bolt which is easily and safely unloaded without any likelihood of injuring personnel by acting as a projectile.

A still further object of the present invention is to provide a gang form or tie rod holding bolt which is relatively simple in construction.

SUMMARY OF THE INVENTION

These and other objects of the present invention which will become apparent as the description proceeds are realized by a device having at least a tie rod holding bolt for holding a tie rod passing through abutting frames of prefabricated panel units and the frames having mating slots. The tie rod holding bolt comprises a body portion, a slot leg extending from a first end of the body portion for entry through the mating slots, a tie rod engaging leg extending from a second end opposite the first end of the body portion, the tie rod engaging leg extending parallel to the slot leg and in the same direction as the slot leg, a middle leg extending from the body portion, spaced from and between the slot leg and the tie rod engaging leg and extending in the same direction as the slot leg and the tie rod engaging leg. The tie rod engaging leg lies in a horizontal plane and the slot leg and middle leg are both outside of the horizontal plane of the tie rod engaging leg and the middle leg and the slot leg are adapted to straddle a tie rod engaged to the tie rod engaging leg. The slot leg and middle leg are disposed in different horizontal planes and the slot leg and middle leg are disposed on opposite sides of the horizontal plane of the tie rod engaging leg. The tie rod engaging bolt is adapted for holding a tie rod having a straight portion and a loop portion with the loop portion around the tie rod engaging leg and with the straight portion disposed in the horizontal plane of the tie rod engaging leg. The slot leg includes a wedge pin accomodating hole. The tie rod holding bolt is adapted to avoid excessive eccentric load by accomodating a tie rod such that the tie rod will maintain a straight axial load on the tie rod holding bolt. The tie rod holding bolt is adapted to transfer loads to the abutting frames by the middle leg and the form slot leg is positioned on the body such that it will have a gap on the front sides of the mating slots.

The assembly of the present invention includes the gang form bolt in combination with a tie rod, two frames, and a wedge pin.

BRIEF DESCRIPTION OF THE DRAWINGS

The above and other features of the present invention will be more easily understood when taken in conjunction with the detailed description and the accompanying drawings wherein like reference characters represent like parts throughout and in which:

FIG. 1 shows an exploded view in perspective of the tie rod holding bolt of the present invention and an associated tie rod and associated wedge pin.

FIG. 2 shows a top view of a tie rod bolt as mounted on abutting frames of prefabricated panel units.

DETAILED DESCRIPTION OF THE PREFERRED EMBODIMENTS

Figure 3:
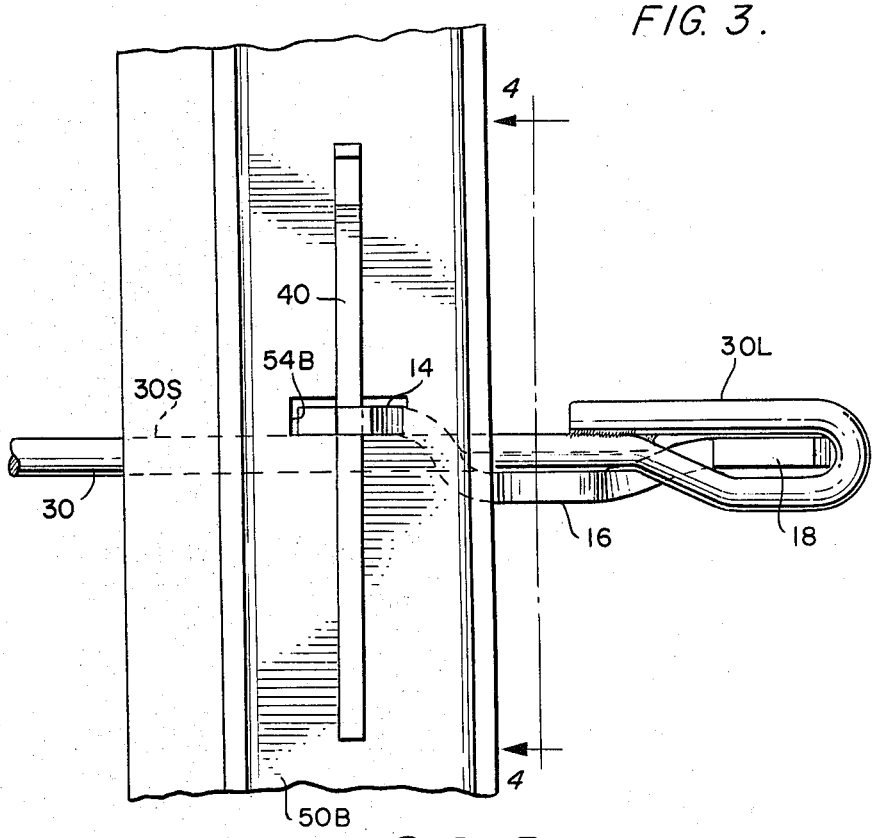
FIG. 3 shows a side view of the installed tie rod holding bolt and associated structure shown in FIG. 2.
Figure 4:
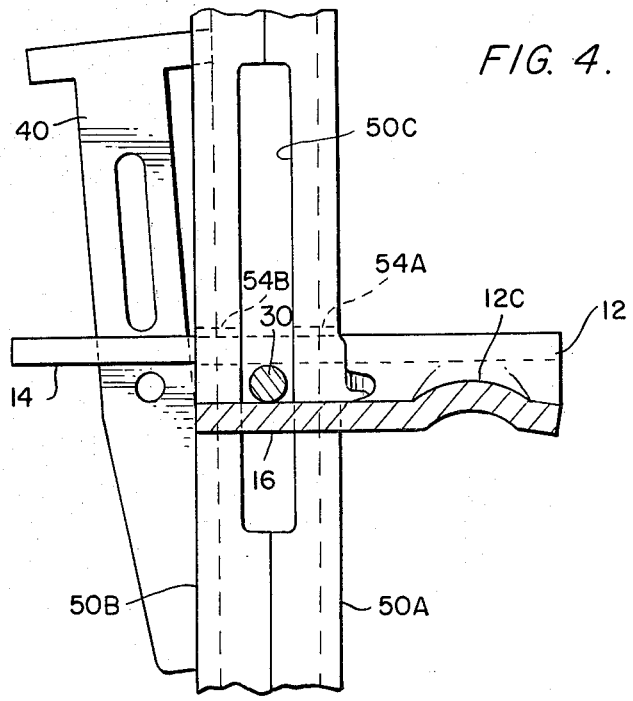
FIG. 4 shows a cross section view taken along lines 4—4 of FIG. 3.

Considering now FIGS. 1, 2, 3, and 4, the tie rod holding bolt 10 according to the present invention will be discussed. FIG. 1 shows an exploded view in perspective of the tie rod holding bolt 10 of the present invention in combination with a tie rod 30 and a wedge pin 40 with phantom lines indicating the installed position of tie rod 30. FIG. 2 shows a top view of the tie rod holding or gang form bolt 10 of the present invention in combination with the tie rod 30, wedge pin 40, abutting frames 50A and 50B, and adjacent panel sections 52A and 52B. FIG. 3 shows a side view of the same assembly as shown in FIG. 2 except that panel sections 52A and 52B are not shown, whereas FIG. 4 shows a cross section view along lines 4—4 of FIG. 3.

The tie rod holding bolt 10 of the present invention includes a body portion 12 shaped as shown and having a raised corrugation 12C for strength, a form slot leg 14 disposed at the front of the body portion 12, a tie rod engaging leg 18 disposed at the back of the body portion 12, and a middle leg 16 disposed in between the form slot leg 14 and the tie rod engaging leg 18.

The tie rod 30 includes a looped portion 30L and a straight portion 30S, the looped portion 30L being shaped and sized to fit around the tie rod engaging leg 18 with the straight portion 30S disposed in a horizontal plane of the tie rod engaging leg 18. In addition to the straight portion 30S of the tie rod 30 being disposed in the plane of the tie rod engaging leg 18, the slot leg 14 and the middle leg 16 are both outside of the substantially horizontal plane (i.e., within 15 degrees of horizontal) of the tie rod engaging leg 18 and the middle leg 16 and slot leg 14 are adapted to straddle the tie rod 30 engaged to the tie rod engaging leg 18. This feature is best shown in FIG. 3. Further, the slot leg 14 and the middle leg 16 are disposed in different substantially horizontal planes on opposite sides of the substantially horizontal plane of the tie rod engaging leg 18. The substantially horizontal planes will preferably be horizontal. As used herein, "horizontal" or "substantially horizontal" refers to the parts of the holding bolt 10 when it is installed. For example, to say that tie rod engaging leg 18 is in a horizontal plane means that in its installed orientation leg 18 will be in a horizontal plane.

The slot leg 14 includes a wedge pin accomodating hole 14H such that wedge pin 40 may be mounted therein. A stop portion 14S prevents leg 14 from being pushed too far into mating slots 54A and 54B. Quite importantly, the tie rod holding bolt 10 is shaped with relative distances between the form slot leg 14, middle leg 16, and tie rod engaging leg 18 such that there will be a gap between the form slot leg 14 and the front of the mating slots 54A and 54B on the abutting frames 50A and 50B. Instead of form slot leg 14 contacting the front (i.e., that portion closest to panel sections 52A and 52B) of the mating slots 54A and 54B, the front edge 16L of middle leg 16 will be in contact with the back of the two abutting frames 50A and 50B.

OPERATION

The use of the present invention will be readily appreciated by those of ordinary skill in the art, but will be briefly reviewed herein. The assembly of the present invention may be assembled by sliding the tie rod holding bolt 10 into the two abutting frames 50A and 50B with the tie rod 30 already in place extending through slot 50C at the back of frames 50A and 50B and a similar slot at the front of frames 50A and 50B. The form slot leg 14 will slide through the mating slots 54A and 54B and the tie rod engaging leg 18 will slide into the loop 30L. The load or front edge 16L of middle leg 16 will be disposed adjacent the back of the abutting frames 50A and 50B. The frames 50A and 50B would be bolted together (bolts not shown) in a manner well known in the art. The wedge pin 40 may be inserted into the wedge pin accomodating hole 14H to lock the tie rod holding bolt 10 in place.

The operation of the present gang form or tie rod holding bolt of the present invention under a tension load will presently be discussed. In particular, the legs 14, 16 and 18 of the gang form bolt 10 are arranged so that the tie rod straight portion 30S will remain straight under a tension load. The form slot leg 14 which passes through the mating slots 54A and 54B of the form and the middle leg 16 which rests against (i.e., abuts) the back edge of the form or frame members 50A and and 50B are offset so that the center line of the tie rod 30 is midway between these two legs. In addition to this, the tie rod engaging leg 18 which holds the tie rod loop 30L is in alignment with the center line of the tie rod 30. Any tendency of the bolt to tilt is resisted by the tension on the tie which works against an eccentric load on the bolt.

On various earlier designs of bolts, a tilt movement of the bolt released tension on the tie which in turn transferred an eccentric load onto the bolt. Since this tie, as any other tension member, will always resist bending when under load, the straddling of the tie rod 30 by the slot leg 14 and the middle leg 16 resists possible tipping of the gang form or tie rod holding bolt 10. The concept is somewhat similar to a post tension beam. The offset design of the gang form bolt legs 14 and 16 straddle the tie, thereby stabilizing the bolt 10 by the tension load which causes the tie rod 30 to remain straight. As tension in the tie rod 30 increases, the force required to bend the tie rod is increased. Therefore, the bolt 10 is prevented from tipping by tie tension.

Another important feature of the present invention is that the load of the bolt 10 is transferred to the back edge of the form by the middle leg 16 of the gang form bolt 10. The front of the slot leg 12 does not transfer the load to the front of the mating slots. This placement of the load at the middle leg 16 has at least two advantages over some earlier designs which transferred the load to the edge of the form slot by the leading edge of the form slot leg. First, by utilizing the middle leg instead of the form slot leg to transfer the load to the back of the form, the distance between the pivot point and the tie loop leg is shortened which reduces the angle of tipping. Thus reduces the eccentric load on the bolt which would cause premature failure. Second, since the middle leg is shorter than the form slot leg, the distance of travel and the amount of frictional resistance at the load bearing point is reduced. This allows the bolt to be unloaded with the blow of a hammer without completely disengaging the form slot leg, reducing the tendency of the bolt to act as a projectile which could be hazardous to personnel and difficult to recover.

The present design is further advantageous in that having the load bearing point or edge 16L on the back of the form by the middle leg and the arrangement of the form slot leg and middle leg straddling the tie creates a stabilizing condition so that:

Any tendency of the bolt to tip downward which would cause a bending of the tie rod would be resisted by tie rod tension.

Any tendency of the bolt to tip upward which would pull the middle leg away from the form and bend the tie rod about the form slot leg would be controlled by the length of the tie rod and resisted by the tension load on the tie rod.

The double offset of this design allows the tension placed on the tie to resist the aforementioned tipping. Thus, the design of the gang form bolt prevents tipping by this leg arrangement (i.e., form slot leg above tie, middle leg below tie, and tie rod engaging leg at center of tie) which could result in an eccentric load on the bolt and casue a bending failure. An increasing load on the tie rod will tend to keep the tie rod and bolt in alignment, in contrast to some prior art designs wherein an increasing load could cause the bolt to rotate which would develop an eccentric load possibly leading to fold-over failure of the bolt.

The tie holding bolt 10 according to the present invention may be made of metal, steel, or other stress resistant materials commonly used for tie rod bolts.

Although various details have been disclosed herein, it is to be understood that these details are to be for illustrative purposes only. Various modifications adaptations of the present invention will be readily apparent to those of ordinary skill in the art. Accordingly, the scope of the present invention should be determined by reference to the appended claims.

What is claimed is:

1. A device having at least a tie rod holding bolt for holding a tie rod passing through abutting frames of prefabricated panel units and keeping gang form sections in place, the frames having mating slots, the tie holding bolt comprising:

a body portion;

a slot leg extending from a first end of said body portion for entry through the mating slots;

a tie rod engaging leg extending from a second end, opposite said first end, of said body portion, said tie rod engaging leg extending parallel to said slot leg and in the same direction as said slot leg;

a middle leg extending from said body portion, spaced from and between said slot leg and said tie rod engaging leg and extending in the same direction as said slot leg and sid tie rod engaging leg; and wherein said tie rod engaging leg lies in a substantially horizontal plane, and said slot leg and said middle leg are both outside of said substantially horizontal plane of said tie rod engaging leg, and said middle leg and said slot leg are adapted to straddle a tie rod engaged to said tie rod engaging leg with said middle leg abutting the frames, wherein said slot leg and said middle leg are disposed on opposite sides of said substantially horizontal plane of said tie rod engaging leg, and wherein said tie holding bolt is adapted to resist tipping by the resistance of a tie rod from bending a straight portion of the tie rod.

2. The device of claim 1 wherein said slot leg and said middle leg are disposed in different substantially horizontal planes.

3. The device of claim 2 further adapted for holding a tie rod having a straight portion and a loop portion with the loop portion around said tie rod engaging leg and with the straight portion disposed in said substantially horizontal plane of said tie rod engaging leg.

4. The device of claim 3 wherein said slot leg includes a wedge pin accomodating hole.

5. The device of claim 1 or 3 wherein said tie rod holding bolt is adapted to avoid excessive eccentric load by accomodating a tie rod such that the tie rod will maintain a straight axial load on said tie rod holding bolt.

6. The device of claim 1 wherein said tie holding bolt is adapted to transfer loads to the abutting frames by said middle leg, and said slot leg is positioned on said body such that it will not place a load on the front sides of the mating slots.

7. The device of claim 6 wherein said slot leg and said middle leg are disposed in different substantially horizontal planes and said slot leg and said middle leg are disposed on opposite sides of said substantially horizontal plane of said tie rod engaging leg.

8. The device of claim 7 wherein said slot leg includes a wedge pin accomodating hole.

9. The device of claim 1 or 7 further adapted for holding a tie rod having a straight portion and a loop portion with the loop portion around said tie rod engaging leg with the straight portion disposed in said substantially horizontal plane of said tie rod engaging leg.

10. An assembly for keeping gang form sections in place including a tie rod holding bolt for holding a tie rod passing through abutting frames of prefabricated panel units, the frames having mating slots, the tie holding bolt comprising:

a body portion;

a slot leg extending from a first end of said body portion for entry through the mating slots;

a tie rod engaging leg extending from a second end, opposite said first end, of said body portion, said tie rod engaging leg extending parallel to said slot leg and in the same direction as said slot leg; a middle leg extending from said body portion, spaced from and between said slot leg and said tie rod engaging leg and extending in the same direction as said slot leg and said tie rod engaging leg; and wherein said tie rod engaging leg lies in a substantially horizontal plane, and the assembly further includes;

two frames having mating slots, a tie rod having a straight portion, said tie rod engaged to said tie rod engaging leg and extending between said two frames, and wherein said slot leg extends through said mating slots and a load on said tie rod is transferred to said two frames by said middle leg abutting said two frames, said slot leg being sufficiently close to said middle leg such that said slot leg does not transfer the tie rod load to said two frames, and wherein said slot leg and middle leg are disposed in different substantially horizontal planes and straddle said tie rod, and wherein said tie holding bolt is adapted to resist tipping by the resistance of said tie rod to bending of said straight portion.

11. The assembly of claim 10 wherein said tie rod includes a straight portion disposed in said substantially horizontal plane of said tie rod engaging leg.

12. The assembly of claim 11 wherein said slot leg and said middle leg are disposed on opposite sides of said substantially horizontal plane of said tie rod engaging leg.

13. The assembly of claim 12 wherein said tie rod has a straight portion and a loop portion and said loop portion is disposed around said tie rod engaging leg and said straight portion is disposed in said substantially horizontal plane of said tie rod engaging leg.

14. The assembly of claim 12 wherein said slot leg includes a wedge pin accomodating hole.

15. The device of claim 10 or 13 wherein said tie rod holding bolt is adapted to avoid excessive eccentric load by having said tie rod maintain a straight axial load on said tie holding bolt.

* * * * *

UNITED STATES PATENT AND TRADEMARK OFFICE

CERTIFICATE OF CORRECTION

PATENT NO. : 4,405,112

DATED : September 20, 1983

INVENTOR(S) : Max DOUBLEDAY and Anthony J. GALLIS

It is certified that error appears in the above-identified patent and that said Letters Patent is hereby corrected as shown below:

Claim 1, column 5, line 62, "sid" should be --said--.

Signed and Sealed this

*Twenty-second* Day of *November 1983*

[SEAL]

*Attest:*

GERALD J. MOSSINGHOFF

*Attesting Officer*

*Commissioner of Patents and Trademarks*